United States Patent [19]

Simoneit

[11] 3,982,247

[45] Sept. 21, 1976

[54] ANTENNA SPRING COUNTERWEIGHT

[75] Inventor: Kurt Simoneit, Poway, Calif.

[73] Assignee: Rohr Industries, Inc., Chula Vista, Calif.

[22] Filed: Apr. 9, 1975

[21] Appl. No.: 566,242

[52] U.S. Cl. ..... 343/766; 343/912; 267/162

[51] Int. Cl.[2] ..... H01Q 3/02

[58] Field of Search ..... 267/162; 188/260; 343/763, 765, 766, 912

[56] References Cited

UNITED STATES PATENTS

| | | | |
|---|---|---|---|
| 2,918,238 | 12/1959 | Zollinger | 267/162 |
| 2,931,035 | 3/1960 | Reinhard et al. | 343/766 |
| 2,945,229 | 7/1960 | Klauser | 343/761 |
| 2,981,511 | 4/1961 | Suozzo | 267/162 |
| 3,439,550 | 4/1969 | Goulding | 343/765 |

*Primary Examiner*—Eli Lieberman
*Attorney, Agent, or Firm*—Patrick J. Schlesinger; Frank D. Gilliam

[57] ABSTRACT

A primary antenna reflective structure is supported for pivotal movement in the elevation direction between the zenith and horizontal points. Drive motors via a bull gear rotates the antenna through its permissible travel. Inertia counterbalance is utilized to control the motion of the antenna. That counterbalance comprises a pinion driven by the bull gear. Left and right guides are integral with the pinion and followers are contained within housings and are adapted to be driven by the guides. The followers move in opposite directions and either compress or relax springs which are housed concentric with the guides. The guides comprise either a ball screw or roller screw, and the followers either a ball nut or roller nut.

24 Claims, 8 Drawing Figures

10
11
20
32
26
24
18
23
22
22
23
14
15
12

Fig. 2
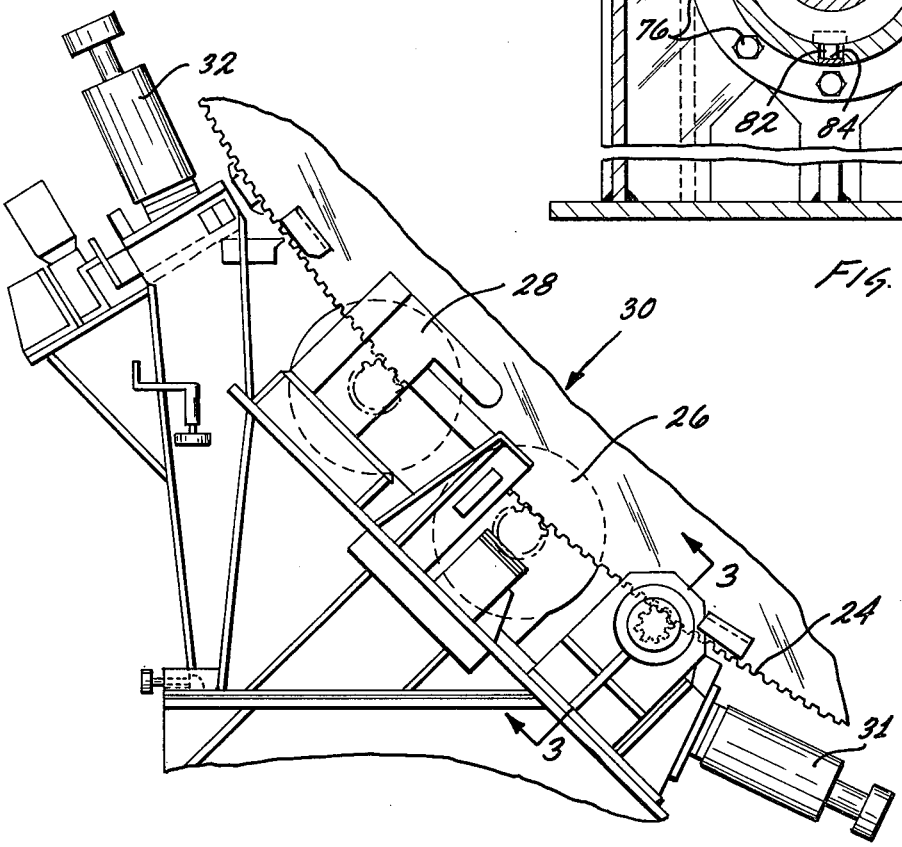
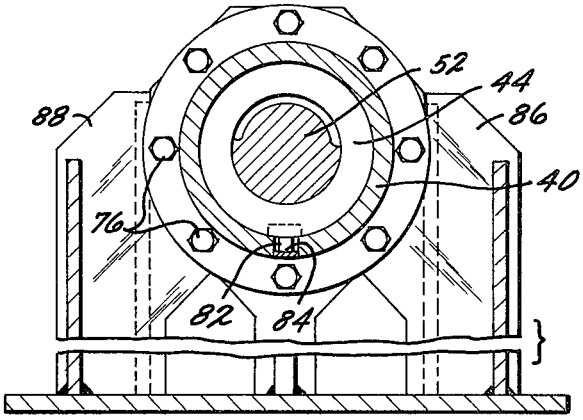
Fig. 5
Fig. 6
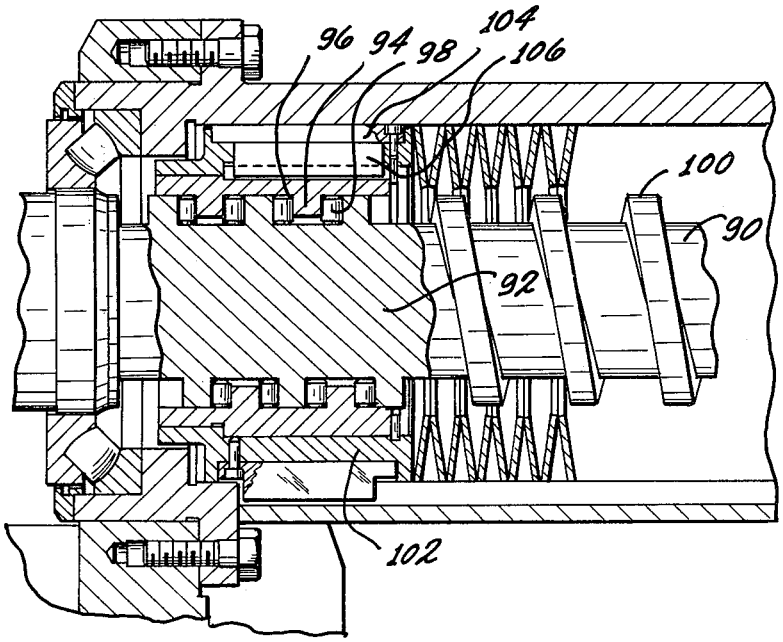

ANTENNA SPRING COUNTERWEIGHT

BACKGROUND OF THE INVENTION

The present invention relates to an inertial counterbalance for an antenna.

The present art radar antenna and the like tend to be constructed with a very high mass which must be conveniently rotated in the elevation direction between zenith and horizontal stations. The structures may be quite heavy, on the order of several thousand pounds and it has been found quite difficult to move these antennas with reliability and safety.

In recognition of this problem several attempts have been made at counterbalancing the inertia of the antenna to simplify the dynamic motion problems. These attempts have generated some undesirable results. Counterbalancing means usually include counterweights which have structurally interferred with the pedestal structures of the antenna. Such interference prevents desired full hemispherical sky clearance and limits the effectiveness of the antenna.

In U.S. Pat. No. 3,233,475, to Barber, the counterbalancing means comprises a series of gears disposed directly beneath the pivotal axis of the antenna structure. U.S. Pat. No. 3,375,523 illustrates another attempt to counterbalance the antenna.

The devices illustrated in the above patents and several others known in the art are somewhat effective in reducing the inertia of the antenna and to some degree simplify the response necessary of the drive motor means. However, all the prior art devices, in one way or another, do not completely solve the problem that the present invention is directed toward. The instant invention acts as a counterweight when the antenna is rotated from its zenith position toward its horizontal position and decreases the possibility that the antenna will inadvertantly fall too fast thereby damaging its critical components. The counterbalance also acts to store energy during the descent of the antenna structure, which energy is available to assist in its ascent toward its zenith point.

SUMMARY OF THE INVENTION

It is the primary object of the present invention to provide an antenna inertial counterbalance which controls the rate of descent of the antenna structure.

Another object of the instant invention is the provision of an inertia counterbalance which stores energy during the antenna descent which is available to assist in raising the antenna.

Still another object of the present invention is the provision of an inertial counterbalance which is characterized by durability, reliability and a simplicity of structure.

In accordance with above designs, an inertial counterbalance is assembled to a primary antenna such that it is responsive to the primary drive means of that antenna. A primary antenna reflective structure is conventionally supported on a pedestal type base by means of a series of struts. The primary drive motors rotate the reflective structure about a generally centrally located axis of rotation by means of a bull gear. The bull gear in turn drives a pinion to which are integrally assembled left and right guide means. The guide means are preferably elongated ball screws or elongated cylindrical rollers which extend the length of twin housings situated on either side of the pinion.

Resilient means in the nature of a stacked series of Belleville washers is disposed within the housings concentric with the guide means. The follower means in the nature of a ball nut to be utilized with the ball screw and a roller nut to be utilized with a roller screw are contained in the housings and are responsive to the rotational motion of the guide means generated by the pinion. In the ball screw and the ball nut combination, a plurality of ball bearings are received within an internal race in the ball nut and in the race of the ball screw. The ball bearings reduce friction and permit the follower to translate along the ball screw with a relatively unresisted motion. The alternate embodiment roller nut contains at least one finger cage into which are received a series of roller bearings which are also active on the sides of the threads of the roller screw. This combination functions similarly to reduce friction and permit the follower to travel with reduced friction. The roller screw may be provided with a replaceable outer ring section which in combination with the roller screw threads forms the finger cage.

The housings are provided with key-ways and both the ball nut and roller nut are provided with keys which protrude into the key-ways and insure proper alignment of the follower means with respect to the guide means. In the embodiment utilizing the roller nut, a similar key arrangement insures proper alignment between the roller nut and the replaceable ring part.

In each embodiment, a stack of resilient means in the nature of Belleville washers are alternately compressed and relaxed by the follower means. The washer means may be made up of individual, doubly parallel, triply parallel washers and also of varying thicknesses so as to correspond to a load curve associated with an individual antenna. To increase the load the washers can be stacked in parallel. To increase the deflection the washers may be stacked in series. As the antenna is rotated from its zenith position towards its horizontal position the guide means drive the follower means outwardly from the pinion. This motion results in the compression of the Belleville washers. The further the antenna structure descends the greater the compression of the Belleville washers. This compression resists the descent of the antenna and thus controls the rate of fall of that massive structure. The stored energy in the Belleville washers may be utilized during the ascending motion of the antenna, to somewhat counterbalance the inertia of that massive structure.

The above and other aspects of the instant invention will be apparent as the description continues and when read in conjunction with the appended drawings.

BRIEF DESCRIPTION OF THE DRAWINGS

FIG. 2 is an enlargement of the drive and self-adjusting counterweight system.

FIG. 5 is a section view taken along lines 5—5 of FIG. 4 showing the mounting bracket and key-way of the counterweight.

FIG. 6 is a section like FIG. 4, but showing a modification of the nut and screw unit used in the counterweight.

DETAILED DESCRIPTION OF THE ILLUSTRATED FORM OF THE INVENTION

Figure 1:
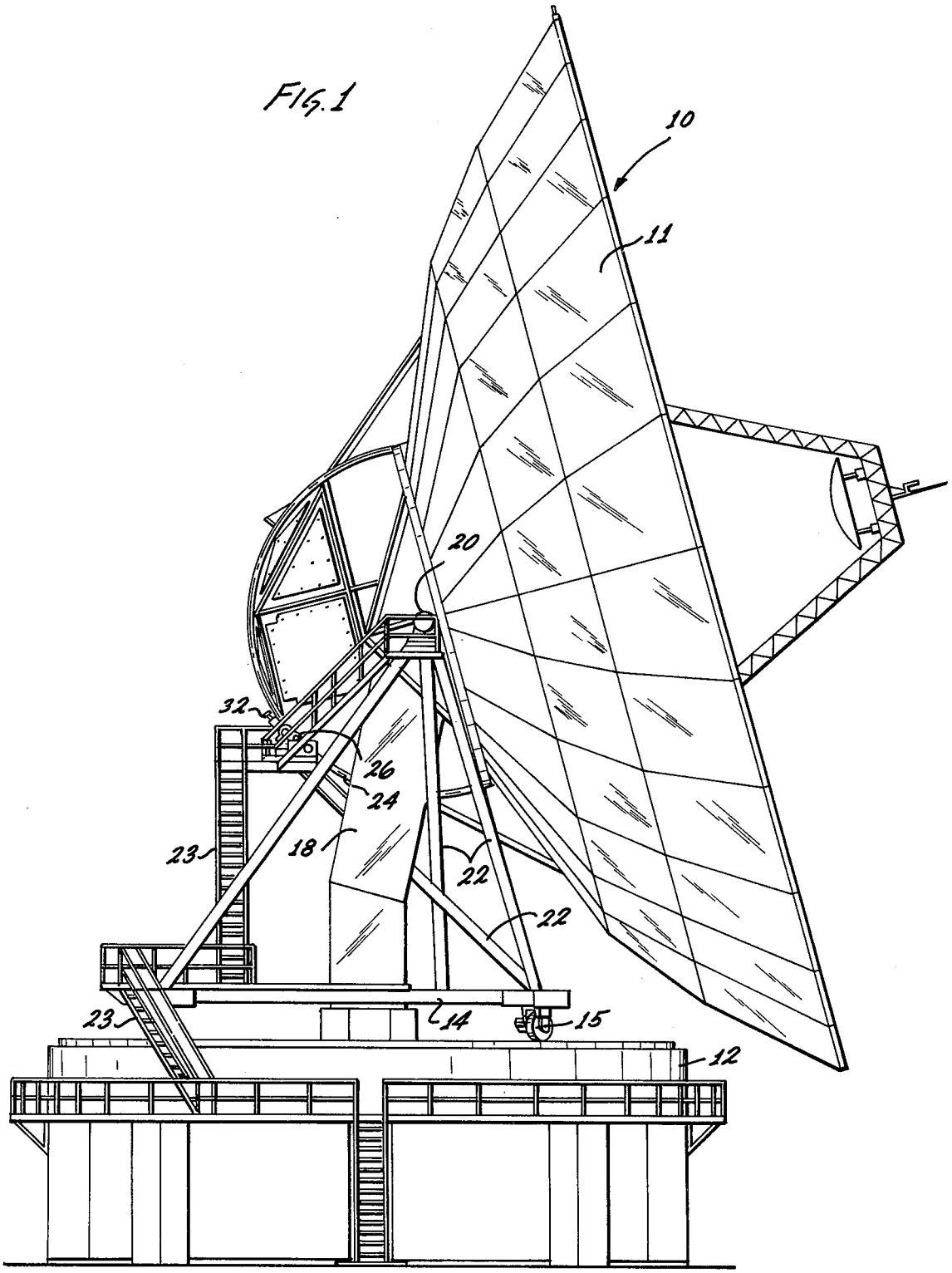
FIG. 1 is a side view of a low silhouette full tracking antenna system.

Referring to FIG. 1, there is illustrated the primary antenna structure 10 having a massive reflector 11 mounted on a turntable 14 which is permitted to rotate on the pedestal 12 via the rollers 15. The reflector 11 is pivotally mounted to the tower 18 and it pivots about the axis 20. The antenna structure includes conventional supporting struts 22 which form no part of the instant invention. Similarly the various staircases 23 are shown only for completeness.

Referring to FIG. 2, the drive means for the antenna elevational motion are shown in an enlarged view. A quite large bull gear 24 is driven by means of a pair of conventional drive motors 26, 28 which are suitably mounted to the antenna structure 10. The counterweight means 30 is mounted in the vicinity of the drive motor 26. The stops 31, 32 insure against the antenna travelling past its desired motion limits.

Figure 3:
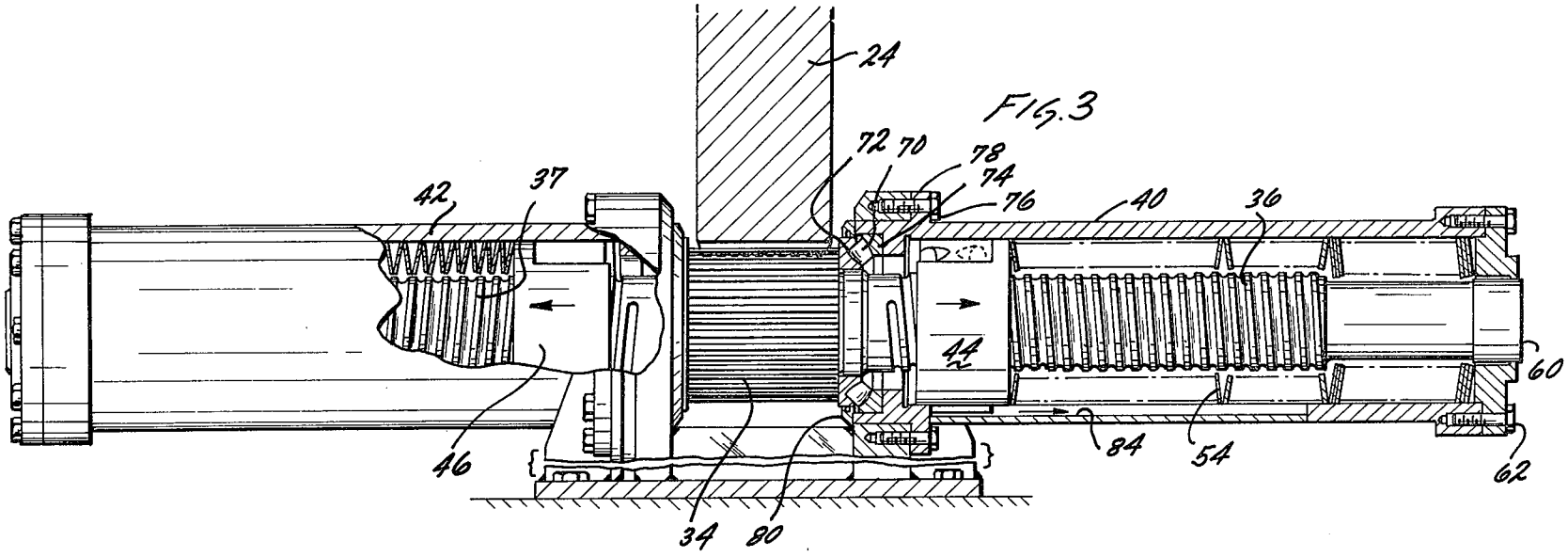
FIG. 3 is a view, partly in section showing the self-adjusting counterweight system taken along line 3—3 of FIG. 2.

In FIG. 3, the bull gear 24 is shown as driving a pinion 34. Fast on the pinion 34 are the left and right guide means 36, 37 which are in the nature of elongated ball screws. The ball screws are situated within housings 40, 42 which are suitably mounted on the antenna structure. Follower means or ball nuts 44, 46 are contained within those housings concentric with the ball screws 36, 37 and designed to translate along those ball screws.

Figure 4:
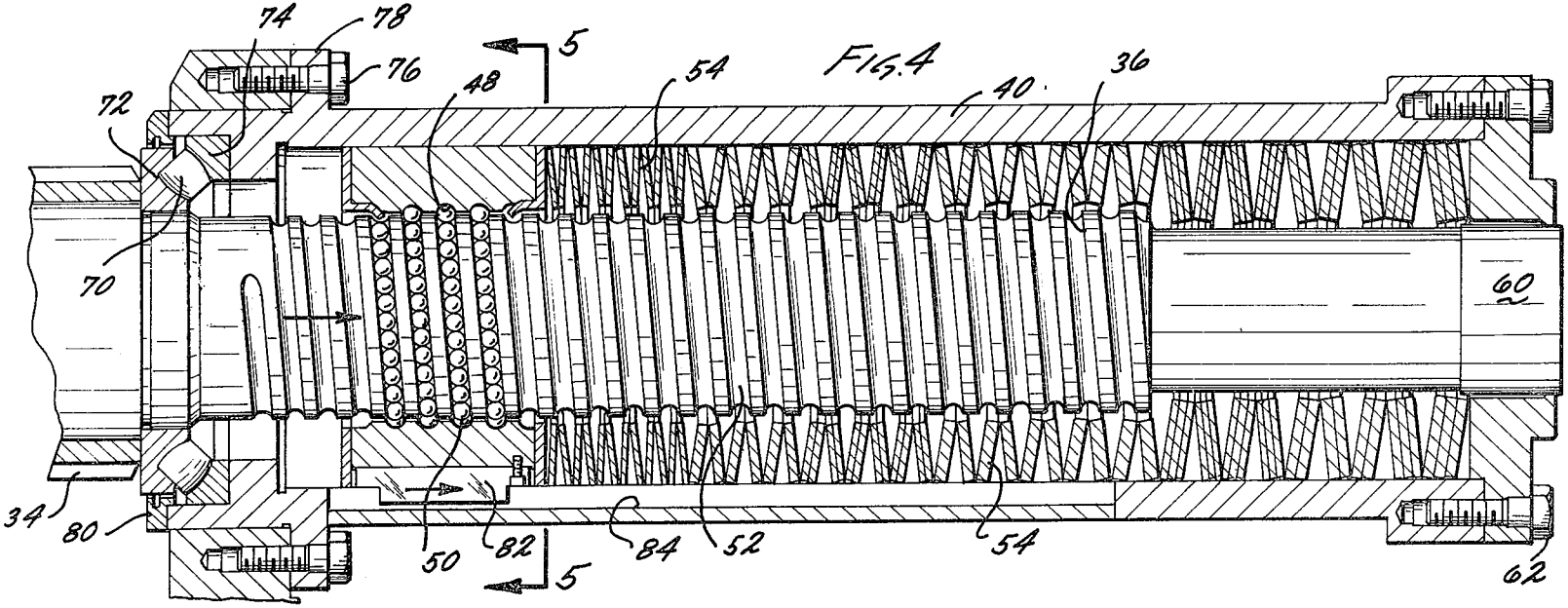
FIG. 4 is an enlarged section view of one side of the self-adjusting counterweight.
Figure 7:
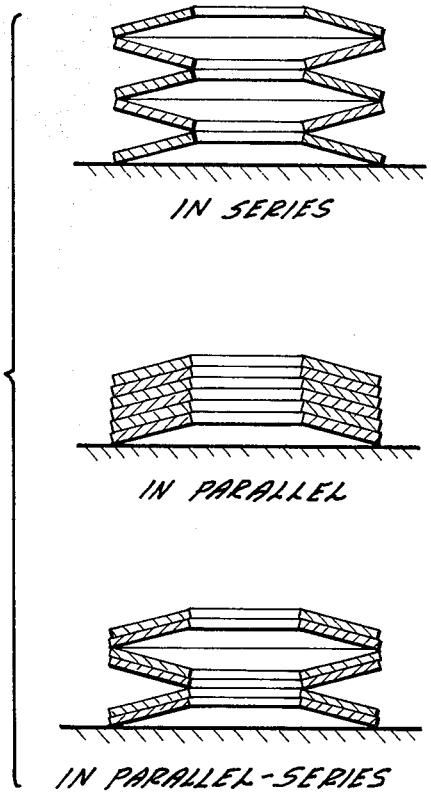
FIG. 7, is a view of Belleville washers in series and parallel.
Figure 8:
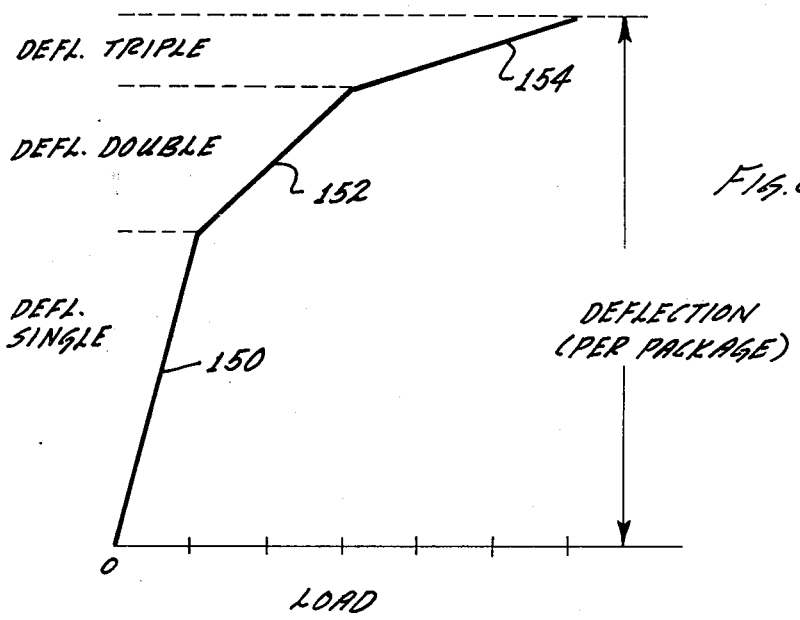
FIG. 8, is a graph illustrating relative deflection of Belleville washers.

As shown in detail in FIG. 4, the ball nuts 44, 46 have an internal threaded race 48 and a plurality of ball bearings 50 ride in the nut race 48 and the corresponding screw race 52. As the bull gear rotates the pinion 34, the ball nuts translate along the ball screws 36, 37 in opposite directions. A series of Belleville washer type springs 54 are concentric with the ball screws 36, 37 and are retained within the housings 40, 42 aft of the follower means 44, 46. FIG. 7, illustrates some of the various Belleville washer combinations that may be utilized to accommodate a load curve that may be associated with a given antenna. As the graph of FIG. 8 indicates, the deflection 150 associated with a single washer is larger than the deflection, 152 associated with a doubly parallel washer. It follows that the deflection 152 is greater than the deflection 154 associated with a triply parallel washer. In FIG. 7, washers 156 are singly in series, washers 158 are singly in parallel and washers 160 are doubly in parallel. Stacking the washers in series increases the deflection in proportion to the number of washers, the load remaining substantially the same as with an individual spring. A combination of increased load and increased deflection is achieved by stacking Bellevilles in a series--parallel arrangement.

As the ball nuts translate outwardly the springs 54 are compressed and store energy. The resistance of the springs controls the downward pivoting and counterbalance of the antenna. The springs 54 are stacked in a series of single, double and triple elements and of varying thicknesses such as in FIG. 7, corresponding to the load curve of the antenna. The springs 54 are maintained within the housings 40, 42 by means of the end caps 60 via screws 62 received in the marginal ends of those housings 40, 42. The ball screws 44, 46 are supported by the housings 40, 42 via bearings 70, the inner race 72 being fast on the screw 44 and the outer race 74 held fast by the housing 40. The screws 76 are received in the flanges 78 to bolt the housing 40 to the antenna supporting structure. An annular dust cap 80 functions to maintain the parts free of contaminants. As shown in FIGS. 4 and 5, a key 82 (on the ball nut) and a key-way 84 in the housing 40 maintain proper alignment between that housing and ball nut. As shown in FIG. 5, the upstanding mounting brackets 86, 88 secure the entire counterweight to the antenna structure.

FIG. 6 illustrates an alternate embodiment for the guide means and the follower means. The guide means therein comprises a roller screw 90 and the follower means is a roller nut 92. A replaceable ring part 94 has finger cages 96 into which are fit a plurality of roller bearings 98. The roller bearings 98 are thrust against the threads 100 and the roller nut translates similar to the ball nut of the previous embodiment. An outer ring part 102 encapsulates the ring part 94 and relative alignment is affected via the key and key-way arrangement 104, 106. In all other respects this embodiment functions as does the embodiment of FIGS. 3 and 4.

The counterweight hereinbefore described is effective to control the antenna motion in the downward path and also serves to assist the ascending motion of the antenna when it is to be raised. This device may be utilized with any large mass that is pivotable in the elevation direction. The antenna illustrated merely represents an exemplary utilization of the concept herein defined. The guide means on either side act independently in storing and retrieving the energy in the Belleville washers. When the energy is to be retrieved the system is biased upwardly and the ascent of the mass is assisted thereby. For descending motion the compression of the washers provides resistance to an abrupt fall of the mass which would destroy the structure.

Modifications and adaptations in the method and materials of fabrication, in the assemblage and configuration of the constituent elements may be made without departing from the scope of the appended claims, which changes are intended to be embraced therewithin.

I claim:

1. In an antenna of the type having primary reflective structure means and means to pivot said structure means in the elevation direction, said pivot means comprising drive motor means, the improvement of which comprises inertia counterbalance means comprising:

driven means responsive to the motion of said drive motor means;

a housing;

guide means fast on said driven means and rotatable in said housing;

follower means interacting with said guide means and adapted for translation along said guide means between positions corresponding to antenna zenith and horizontal elevation positions; and resilient means within said housing and alternately compressed and relaxed by the movement of said follower means.

2. In the antenna of claim 1 left and right guide means disposed symmetrically about said driven means, and left and right follower means associated with each of said left and right guide means respectively.

3. In the antenna of claim 1, said guide means comprises a ball screw.

4. In the antenna of claim 1, said guide means comprises a roller screw.

5. In the antenna of claim 3, said follower means comprises a ball nut contained within said housing and having an internal race, and ball bearings secured within said internal race and said ball screw threads.

6. In the antenna of claim 4, said follower comprises a roller nut having an internal finger cage, roller bearings received in said finger cage and between said roller screw threads.

7. In the antenna of claim 1, said resilient means comprise a series of stacked, individual spring washers stacked in a series of parallel, single, double and triple washers corresponding to the load curve of the antenna motion.

8. In the antenna of claim 1, a key-way in said housing and a key fast on said follower means and protruding into said key-way to maintain relative alignment between said guide and follower means.

9. In the antenna of claim 6, said roller nut comprises a replaceable ring part having interior channels which form part of said finger cages, said roller nut having an interior key-way and said ring part having a key protruding into said key-way to maintain relative alignment between said ring part and said follower means.

10. In the antenna of claim 1, said guide means comprises a ball screw, said follower means comprises a ball nut contained within said housing and having an internal race, ball bearings received within said internal race and said ball screw threads, said resilient means comprise a series of stacked, individual spring washers stacked in a series of varying thicknesses and of varying parallel individual elements to correspond to the load curve of the antenna motion.

11. In the antenna of claim 2, said guide means comprises a ball screw, said follower means comprises a ball nut contained within said housing and having an internal race, ball bearings received within said internal race and said ball screw threads, said resilient means comprise a series of stacked, individual spring washers stacked in a series of varying thicknesses and of varying parallel individual elements to correspond to the load curve of the antenna motion.

12. In the antenna of claim 11, said left and right follower means comprise ball screws with oppositely disposed threads and said left and right follower means comprise ball nuts which translate equally in opposite directions.

13. In the antenna of claim 1, said guide means comprises a roller screw, said follower means comprises a roller nut contained within said housing and having an internal finger cage, roller bearings received in said finger cage and between said roller screw threads, said resilient means comprise a series of stacked, individual spring washers stacked in a series of varying thicknesses and of varying individual parallel elements to correspond to the load curve of the antenna motion.

14. In the antenna of claim 2, said guide means comprises a roller screw, said follower means comprises a roller nut contained within said housing and having an internal finger cage, roller bearings received in said finger cage and between said roller screw threads, said resilient means comprise a series of stacked, individual spring washers stacked in a series of varying thicknesses and of varying individual parallel elements to correspond to the load curve of the antenna motion.

15. In the antenna of claim 14, said left and right follower means comprise roller screws with oppositely disposed threads and said left and right follower means comprise ball nuts which translate equally in opposite directions.

16. A counterbalance to control motion of a movable mass in a gravity assisted direction which comprises:

a housing;

jack screw rotatable in said housing, said jack screw having oppositely disposed threads on each side of center;

a pair of threaded nuts one interacting with each side of said jack screw and adopted for translation along said jack screw between positions corresponding to movable mass zenith and horizontal elevation positions; and stacked spring washers within said housing and alternately compressed and relaxed by the movement of said pair of threaded nuts.

17. A counterbalance to control motion of a movable mass in a gravity assisted direction which comprises:

a housing;

left and right guide means rotatable in said housing;

left and right follower means interacting with said left and right guide means respectfully and adopted for translation along said guide means between positions corresponding to movable mass zenith and horizontal elevation positions; and resilient means within said housing and alternately compressed and relaxed by the movement of said follower means.

18. In the counterbalance of claim 17, said guide means comprises a ball screw.

19. In the counterbalance of claim 17, said guide means comprises a roller screw.

20. In the counterbalance of claim 18, said follower means comprises a ball nut contained within said housing and having an internal race, and ball bearings secured within said internal race and said ball screw threads.

21. In the counterbalance of claim 19, said follower comprises a roller nut having an internal finger cage, roller bearings received in said finger cage and between said roller screw threads.

22. In the counterbalance of claim 17, said resilient means comprise a series of stacked, variably stacked and sized individual spring washers corresponding to the load curve of the movable mass motion.

23. In the counterbalance of claim 17, a key-way in said housing and a key fast on said follower means and protruding into said key-way to maintain relative alignment between said guide and follower means.

24. In the counterbalance of claim 21, said roller nut comprises a replaceable ring part having interior channels which form part of said finger cages, said roller nut having an interior key-way and said ring part having a key protruding into said key-way to maintain relative alignment between said ring part and said follower means.

* * * * *